US009826780B2

(12) United States Patent
Krietzman

(10) Patent No.: US 9,826,780 B2
(45) Date of Patent: Nov. 28, 2017

(54) CONVECTION VAPORIZERS

(71) Applicant: Mark Krietzman, Palos Verdes Estates, CA (US)

(72) Inventor: Mark Krietzman, Palos Verdes Estates, CA (US)

( * ) Notice: Subject to any disclaimer, the term of this patent is extended or adjusted under 35 U.S.C. 154(b) by 98 days.

(21) Appl. No.: 15/045,478

(22) Filed: Feb. 17, 2016

(65) Prior Publication Data

US 2016/0235124 A1 Aug. 18, 2016

Related U.S. Application Data

(60) Provisional application No. 62/116,926, filed on Feb. 17, 2015, provisional application No. 62/127,817, filed on Mar. 3, 2015, provisional application No. 62/184,396, filed on Jun. 25, 2015, provisional application No. 62/208,786, filed on Aug. 23, 2015, provisional application No. 62/270,557, filed on Dec. 21, 2015.

(51) Int. Cl.

| | |
|---|---|
| ***A24F 47/00*** | (2006.01) |
| ***H05B 1/02*** | (2006.01) |
| ***A24B 15/16*** | (2006.01) |
| ***H05B 3/14*** | (2006.01) |
| ***H05B 3/42*** | (2006.01) |

(52) U.S. Cl.

CPC ..... *A24F 47/008* (2013.01); *A24B 15/16* (2013.01); *H05B 1/0225* (2013.01); *H05B 1/0244* (2013.01); *H05B 3/146* (2013.01); *H05B 3/42* (2013.01); *H05B 2203/014* (2013.01); *H05B 2203/021* (2013.01); *H05B 2203/022* (2013.01)

(58) Field of Classification Search

CPC ..... A24F 47/008; H05B 1/0244; H05B 3/42; H05B 2203/022; A61M 11/042; A61M 15/06

See application file for complete search history.

(56) References Cited

U.S. PATENT DOCUMENTS

| | | | | |
|---|---|---|---|---|
| 9,414,629 | B2 * | 8/2016 | Egoyants | A24F 47/008 |
| 9,516,899 | B2 * | 12/2016 | Plojoux | A24F 47/008 |
| 9,609,894 | B2 * | 4/2017 | Abramov | A24F 47/008 |
| 9,675,117 | B2 * | 6/2017 | Li | A61M 15/06 |
| 2014/0202476 | A1 * | 7/2014 | Egoyants | A24F 47/008 131/329 |
| 2014/0366898 | A1 * | 12/2014 | Monsees | A24F 47/008 131/329 |
| 2016/0198771 | A1 * | 7/2016 | Goggin | A24F 47/008 131/329 |
| 2016/0255879 | A1 * | 9/2016 | Paprocki | H05B 1/0291 |
| 2016/0331033 | A1 * | 11/2016 | Hopps | A24F 47/008 |
| 2017/0108210 | A1 * | 4/2017 | Meinhart | F22B 1/30 |
| 2017/0119051 | A1 * | 5/2017 | Blandino | A24F 47/008 |
| 2017/0156407 | A1 * | 6/2017 | Abramov | A24F 47/008 |

* cited by examiner

*Primary Examiner* — Ross Gushi

(57) ABSTRACT

Disclosed herein are methods and systems to vaporize extract, plant material containing organic material and the like utilizing convection heating via one or more manifolds each in fluid communication with a section of chamber containing organic material. The manifolds may be valved and may contain temperature sensors.

14 Claims, 14 Drawing Sheets

CONVECTION VAPORIZERS

RELATED APPLICATION

This application claims the priority to U.S. ("U.S.") Provisional Patent Application Ser. No. 62/116,926 entitled CARTRIDGE AND HEATER filed on 17 Feb. 2015, the disclosure of which is incorporated by reference herein in its entirety.

Additionally, this application also claims the priority to U.S. Provisional Patent Application Ser. No. 62/127,817 entitled MULTI ZONE VAPORIZER filed on 3 Mar. 2015, the disclosure of which is incorporated by reference herein in its entirety.

Furthermore, this application also claims the priority to U.S. Provisional Patent Application Ser. No. 62/184,396 entitled VAPORIZER DEVICE AND METHOD 25 Jun. 2015, the disclosure of which is incorporated by reference herein in its entirety.

Furthermore, this application also claims the priority to U.S. Provisional Patent Application Ser. No. 62/208,786 entitled VAPORIZER CARTRIDGE AND HEATER 23 Aug. 2015, the disclosure of which is incorporated by reference herein in its entirety.

Still furthermore, this application also claim priority to U.S. Provisional Patent Application Ser. No. 62/270,557 entitled THIN CONVECTION VAPORIZER filed 21 Dec. 2015 the disclosures of which is incorporated by reference herein in their entirety as if fully set forth herein.

BACKGROUND OF THE DISCLOSURE

1. Field of the Disclosure

The present disclosure relates generally to heating system and device that releases organic residues from volatile oils, essential oils, extracts and plant based material upon appropriate heating release without combustion.

2. Related Art

Vaporizer for plant based materials and essential oils and exist. Vaporizers which allow a fluid gas containing the vapor and other residues to follow a fluid pathway from source of vapor to user inhalation exist. *Cannabis* and other botanicals have been known in the art to be vaporized or burned to release organic material in the form of inhalable material. Vaporizing at correct temperatures can boil off the oils for inhalation without combusting the plant material.

*Cannabis sativa* contains over 421 different chemical compounds, including over 60 cannabinoids. Cannabinoid plant chemistry is far more complex than that of pure THC, and different effects may be expected due to the presence of additional cannabinoids and other chemicals. Eighteen different classes of chemicals, including nitrogenous compounds, amino acids, hydrocarbons, carbohydrates, terpenes, and simple and fatty acids, contribute to the known pharmacological properties of *cannabis*.

*Cannabis*, for example has a narrow range at which it can be heated to release "THC" (Tetrahydrocannabinol (THC), or more precisely its main isomer (−)-trans-$\Delta^9$-tetrahydrocannabinol) and CBDs (Cannabidiol loosely referring to as many as 85 identified compounds in *Cannabis*) chemicals as vapor without burning the organic material and adding non-THC and CBD material to the inhalation gases.

Heating a chamber loaded with organic material may, in some instances, overheat at least portions thereof and therefore combust, overheat or otherwise release unwanted items which may include carcinogens and chemicals into the vapor. A portable vaporizer is more portable if it fits easily into a pocket.

It is therefore a desideratum to have a portable device, method and or system wherein such heating is better managed.

DISCLOSURE

In the following description of examples of implementations, reference is made to the accompanying drawings that form a part hereof, and which show, by way of illustration, specific implementations of the present disclosure that may be utilized. Other implementations may be utilized and structural changes may be made without departing from the scope of the present disclosure.

Aspects of vaporizer systems and methods disclosed include a battery power supply; a generally hollow body containing a manifold having an open top; an intake fluidly communicating from the exterior of the body to the manifold; a convection heating system comprising; at least two heating elements each in thermal contact with the manifold; at least one temperature sensor positioned in the manifold; a controller in signal communication with the temperature sensor; a chamber having a air permeable floor fluidly connected to the open top of the manifold; an illumination communication display; an on/off switch; a cover that mates with the body above the chamber having a fluid pathway for vapor inhalation; and, wherein the controller controls the power supplied to each heating element in response to information it processes from the temperature sensor.

In some instances the controller is in signal communication with the communication display.

Aspects of vaporizer systems and methods disclosed include a battery power supply; a generally hollow body containing a manifold having an open top, at least one wall within the manifold to direct airflow; an intake fluidly communicating from the exterior of the body to the manifold; a convection heating system comprising; at least two heating elements each in thermal contact with the manifold; at least one temperature sensor positioned in the manifold; a controller in signal communication with the temperature sensor; a chamber having a air permeable floor fluidly connected to the open top of the manifold; an illumination communication display; an on/off switch; a cover that mates with the body above the chamber having a fluid pathway for vapor inhalation; and, wherein the controller controls the power supplied to each heating element in response to information it processes from the temperature sensor. In some instances a second temperature sensor is within the manifold.

Aspects of vaporizer systems and methods disclosed include a battery power supply; a generally hollow body containing a manifold having an open top, at least one wall within the manifold to direct airflow; an intake fluidly communicating from the exterior of the body to the manifold; a convection heating system comprising; at least two heating elements each in thermal contact with the manifold; at least two temperature sensor positioned in the manifold; at least two zoned regions in the manifold each associated with a temperature sensor; a controller in signal communication with the temperature sensors; a chamber having a air permeable floor fluidly connected to the open top of the manifold; an illumination communication display; an on/off switch; a cover that mates with the body above the chamber having a fluid pathway for vapor inhalation; and, wherein the controller controls the power supplied to each heating element in response to information it processes from the temperature sensor. The controller may controls each heating element to tune the temperature of the air passing through each zone of the manifold.

The above vaporizers, methods and system may include a cover off sensor in signal communication with the controller wherein the controller interrupts power to heating elements if the cover is off.

Aspects of vaporizer systems and methods disclosed include a controller; a heating chamber having an open top surrounded by an annular wall and having a air permeable floor; a manifold in thermal contact with at least two heating elements; an intake to allow air to pass into the manifold; an exit to allow heated air to pass out of the manifold; an on/off switch; a power supply; a cover with an interface to close off the open top of the chamber; an inhalation intake connected to a fluid pathway passing from inside the cover; and, wherein the power supply is electrically connected to the heating elements and the controller via the on/off switch; and, wherein each heating element is separately controlled by the controller.

Aspects of vaporizer systems and methods disclosed include a controller; a heating chamber having an open top surrounded by an annular wall and having a air permeable floor; a manifold in thermal contact with at least two heating elements; at least one temperature sensor in thermal contact with the manifold connected to the controller and the controller in response to temperature sensor measurements adjusts the amount and/or timing of electricity provided to a turned on heating; an intake to allow air to pass into the manifold; an exit to allow heated air to pass out of the manifold; an on/off switch; a power supply; a cover with an interface to close off the open top of the chamber; an inhalation intake connected to a fluid pathway passing from inside the cover; and, wherein the power supply is electrically connected to the heating elements and the controller via the on/off switch; and, wherein each heating element is separately controlled by the controller. In some instances a visible illumination communications is controlled by the controller. In some instances controller at least one of monitors the amount of time a heating element is at a predetermined range of temperature and monitors when a predetermined time is met.

Aspects of vaporizer systems and methods disclosed include placing organic plant material in a chamber; connecting a manifold having a heater therein controlled by a control board connected to a battery supply to at least one valve whereby a fluid pathway for air is provided to the valve; providing a fluid pathway from the valve to at least a portion of the chamber; partially sealing the chamber with a cover having a fluid exit; heating the air in the manifold to a predetermined temperature; the user actuating the valve to open the fluid pathway; the control board indicating to the user via an illumination communication that the users may inhale; and, during inhalation at the fluid exit heated air from the first manifold passes through a predetermined section of the material in the chamber releasing vapor.

FIGURES

The invention may be better understood by referring to the following figures. The components in the figures are not necessarily to scale, emphasis instead being placed upon illustrating the principles of the invention. In the figures, like reference numerals designate corresponding parts throughout the different views.

FIGS. 1A to 3 illustrate aspects of a manifold vaporizer with dual zone heating.

Figures 1A, 1B:
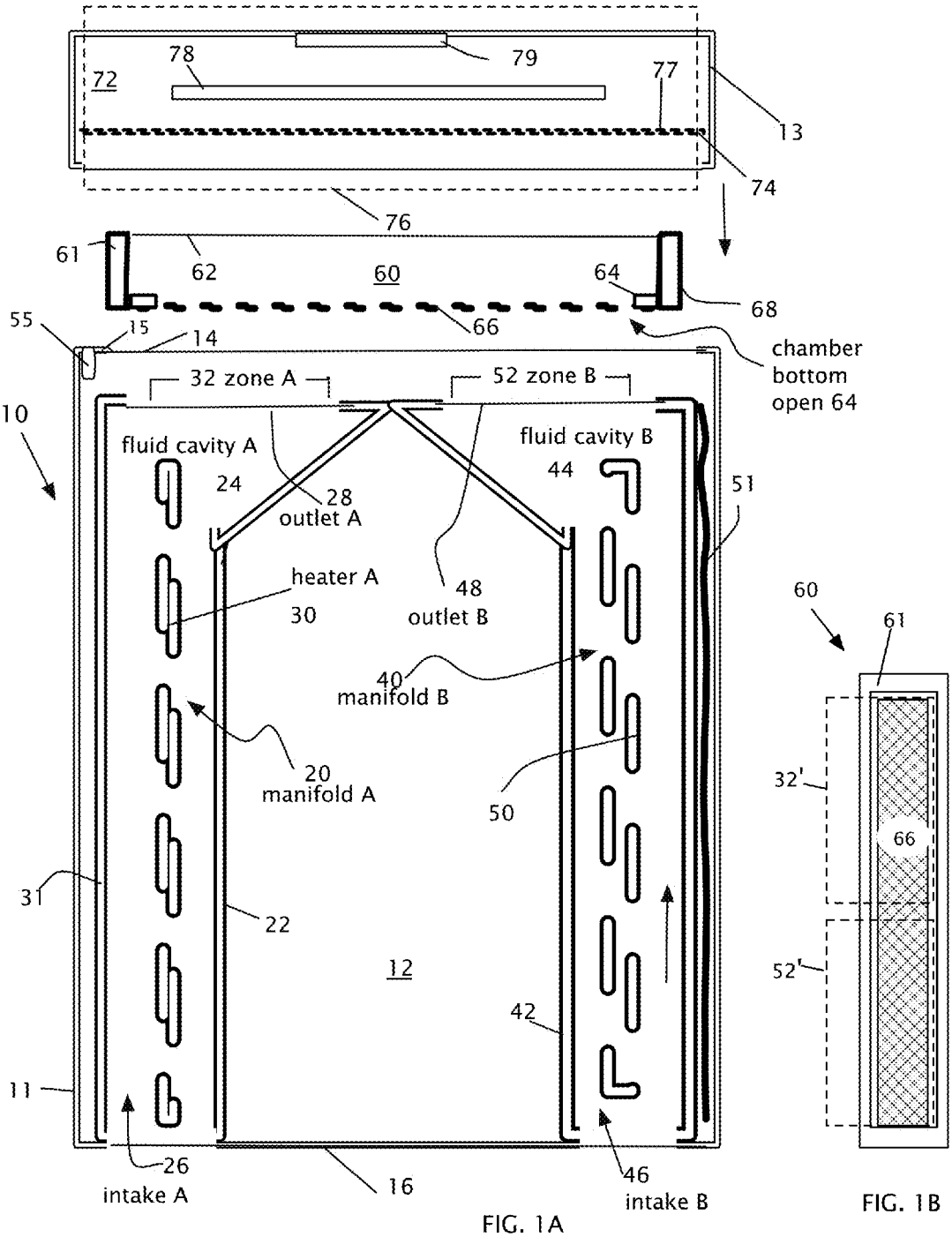
Figure 2:
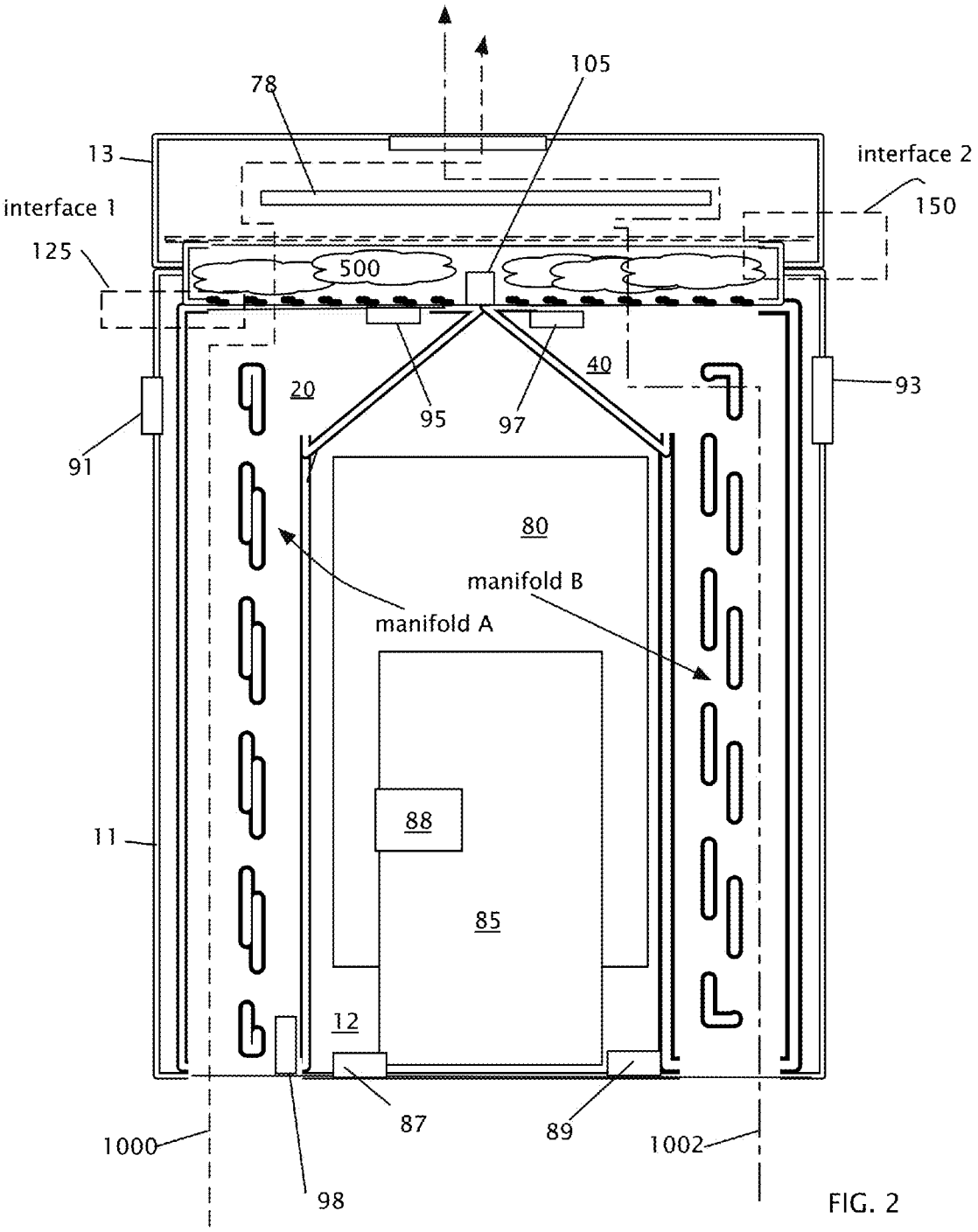

All descriptions and callouts in the Figures and all content therein are hereby incorporated by this reference as if fully set forth herein.

FURTHER DISCLOSURE

Disclosed herein area aspects of a convection vaporizer which provides a thin form. Disclosed herein area aspects of a convection vaporizer which provides a thin manifold heater.

Vaporizing plant material for inhalation of plant borne chemicals is considered by some to be less harmful then combusting the plant material. Tobacco and *cannabis* are examples of such material. Vaporization releases volatile oils, essential oils and organic compounds from materials such as *Cannabis*. The goal of vaporization is to release said vapor without combusting the plant material.

Traditional portable vaporizers are bulky and heat the entire content of a chamber simultaneously. These devices provide heat to the material chamber or conductively heat the chambers walls in both cases applying heat to the totality of the material in the chamber at the same time.

Successive heating of the same material by heating tends to overheat the material and cause charring, combustion and release of harmful smoke.

It is appreciated by those skilled in the art that some of the circuits, components, controllers, modules, and/or devices of the system disclosed in the present application are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical such as, for example, conductive wires, electromagnetic wave guides, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying analog and/or digital formats without passing through a direct electromagnetic connection. These information paths may also include analog-to-digital conversions ("ADC"), digital-to-analog ("DAC") conversions, data transformations such as, for example, fast Fourier transforms ("FFTs"), time-to-frequency conversations, frequency-to-time conversions, database mapping, signal processing steps, coding, modulations, demodulations, etc. The controller devices and smart devices disclosed herein operate with memory and processors whereby code is executed during processes to transform data, the computing devices run on a processor (such as, for example, controller or other processor that is not shown) which may include a central processing unit ("CPU"), digital signal processor ("DSP"), application specific integrated circuit ("ASIC"), field programmable gate array ("FPGA"), microprocessor, etc. Alternatively, portions DCA devices may also be or include hardware devices such as logic circuitry, a CPU, a DSP, ASIC, FPGA, etc. and may include hardware and software capable of receiving and sending information. Pulse width modulation is one method to control the temperature in a manifold by varying the timing and frequency the heating element is heated over time or in response to a temperature sensor.

A multi-zone vaporizer which finely controls heating of a sub-area or subzones within a heating chamber is disclosed. In some instances the control include software, logic and controllers having hardware, memory and microprocessors to control the zone heating and limit, warn about or prevent reheating of a used zone. In some instance the vaporizer includes BLUETOOTH®, WI-FI® or other wireless communication to a smart phone to allow an application on the smart phone to control heating of subzones. In some instance the vaporizer includes BLUETOOTH®, WI-FI® or other wireless communication to a smart phone to allow an application on the smart phone to control temperature settings.

Traditional portable *cannabis* plant material and cannabinoid containing concentrate vaporizers provide a flow pathway from heating unit to inhalation path to user. The heat a chamber which may be metal, ceramic or the like and within the chamber is placed organic material such a plant matter or concentrate which is heated to release vapor. Concentrate may be on a carrier substance. In many cases burning and charring occurs release gas/vapor other than THC or CBDs in the *cannabis* material to be released. Ideal temperature range is about 180-205 C (less than 404 F). In other instance compounds in *Cannabis* may be released at lower temperatures in the range of about 120-180 C.

The instant disclosure teaches aspects of vaporizers utilizing heated air flow (convection) via one or more manifolds to heat plant material. A heater body is taught with a rechargeable battery, a controller, optional memory, temperature sensor(s), a removable lid, a chamber, fluid manifold(s), heater(s), a fluid pathway to intake air, a fluid pathway inhale vapor. Also, disclosed is an on/off switch, indicator/communication illumination, a input/output connection to the control board and/or microprocessor and a recharge connection. Aspects of several heat flow control to provide zonal heating in the chamber to sparingly heat one portion of plant material in the chamber as opposed to heating all the entire chamber and/or all material in the chamber.

In some instances a extract or an extract in a carrier may be placed in the chamber and heated with the heated air rather than plant material.

FIGS. 1A-3 disclose aspects of multiple zone heat flow controlled convection vaporization of organic material including but not limited to terpenes, CBDs and THC. In some instances the vaporizer can be very thin with a thickness of about 6 mm to about 18 mm, more preferably about 7 mm to about 14 mm, and most preferably about 8 mm to about 12 mm.

The chamber should be of a size to contain material for preferably about 4-14 inhalations, more preferably containing material for about 6-12 inhalations and most preferably containing material for about 8-10 inhalations.

To form a thin device with a manifold for heating produces challenges which we have overcome. A thin flat vaporizer manifold has a large surface to volume area and can be less battery efficient having a large area which will cause parasitic heat losses. In some devices, systems and methods using multiple flat zones each with less surface to volume and each with a separate heater can reduce these losses by only heating air to vaporize material in a portion of the device rather than heating all material to vaporize at once. In other instances of devices, systems and methods a single manifold may be used with valves. In yet other instances a single manifold with multiple heating zones in the manifold are disclosed whereby the heated air is finely tuned to maintain a narrow temperature range before said heated air enters a chamber.

A vaporizer device 10 comprises a generally hollow body 11, an interior space 12, a removable cover 13 which partially seals and mates with the open top 14. The open top 14 is formed through the top wall 15 of the body and the chamber to hold material mounts therein. The bottom 16 of the body 12 is closed. However, fluid pathway(s) to provide for airflow to the manifold may be formed through any portion of the body including the closed bottom. The cover forms a part of fluid pathways through the body, chamber, and material to direct air and vapor flow for inhalation.

A first manifold 20 (also called out as manifold "A") comprises a manifold wall 22 a fluid cavity 24, an intake 26, an outlet from manifold "A" 28 to the chamber, and a heater 30. The manifold wall 22 may have a layer of insulation on its exterior 31. The first manifold is positioned to deliver heated air (to a portion of the chamber) via the outlet 28 which opens to a first zone (zone "A") 32 which is formed under only a portion of the chamber.

A second manifold 40 (also called out as manifold "B") comprises a manifold wall 42 a fluid cavity 44, an intake 46, an outlet from manifold "B" 48 to the chamber, and a heater 50. The manifold may be at least partially surrounded by insulation 51. Inside each manifold is a fluid pathway from the intake to the outlet. A cover on/off sensor 55 is placed on the hollow body whereby the removal of or placing on of a cover over the body above the chamber actuates the sensor. The sensor is in signal communication with a control board. The second manifold is positioned to deliver heated air (to a portion of the chamber) air via the outlet pathway 48 which opens to a second zone (zone "B") 52 which is formed under only a portion of the chamber.

The chamber 60 is generally hollow, it has a top wall 61 which has an opening 62 top. The chamber has a bottom wall 64 and a floor 66 which is a screen, slits or other air and vapor permeable region and a annular side wall 68. FIG. 1B shows a top view into the chamber and the floor 66 is visible. A first chamber heating zone 32' is shown, that zone is generally above the first zone 32 (zone "A"). A second chamber heating zone 52' is shown, that zone is generally above the second zone 52 (zone "AB). The chamber heating zones are the area of the chamber above the heating zones. Material (not shown) is placed in the chamber above the floor. The chamber is the tray or vessel that contains plant material or extracts to be vaporized. In some instances the thermal properties of the chamber are such that it heats up slower than the materials therein. A less thermal conductive chamber (or annular wall(s) of the chamber) limit heat transfer to the entire chamber when only one of zone "A" 32 and zone "B" 52 are being heated.

Each of the heating zones "A" and "B" provides a fluid pathway to a portion of the chamber and the chamber's heating zones. It is preferred that heat is directed into the material. The chamber may be a thin walled metal part (such as aluminum or stainless steel), the chamber may be formed of ceramic, it may be formed of high temperature plastics, it may be a metalized plastic, it may be quartz glass or borosilicate. The materials which may be used are plentiful and it is not necessary to provide an exhaustive list. The material should be nonreactive with the vapor and should not outgas any harmful, noxious or toxic compounds when heated to a predetermined vaporization temperature.

To close the device the removable cover 13 is mated to the body 11 over the chamber 60. The cover has an internal cavity 72 into which heated air and vapor from vaporized material fluidly moves. The cover has an open bottom 74 which mates with the body. The open bottom also forms a part of a fluid pathway 76 wherein vapor exiting the chamber is drawn through the cover for use. A screen or other air and vapor permeable floor 77 fits into the open bottom 74 to limit material from being moved into the cavity 72 during inhalation. A baffle 78 can be added in the cavity to direct gas flow (gas being heated air and vapor) through the cover to the exit 79 or inhalation path.

Some of the main components inside the body 11 include battery 80 and control board(s) 85. Those of ordinary skill in the art will recognize that control board includes suitable and necessary electronic connections, microprocessors, and elements such as solid state memory, resistors, capacitors, magnetic components and other circuitry (all well known) to control the flow of electricity to the heaters, interconnect with sensors, as well as for timing of zone heating which may include look up tables (LUTs), pulse width modulation (PWM) to control and tune heating and temperature, sensor input from thermocouples and/or thermistors to control and adjust heating, airflow sensors to monitor rate of airflow, and communications display all of which are within the scope of this disclosure.

An I/O (input output) 87 such as a microusb or a BLUETOOTH®, WI-FI® enabled chip 88 is provided for communication with the control board 85. A recharge connection 89 is provided to recharge the battery 80. The battery in some instances may be replaceable and slide in and out of the body through the bottom 18 (not shown but well known in the art).

An on/off switch 91 which may be a slide switch, pressure switch or any suitable switch is accessible on the body. A communications display 93 which may be as simple as blinking or colored lights such as LEDs or as complex as a LCD (liquid crystal display) is visible on the body. Communication interfaces with a user includes, but is not limited to, illumination via the LEDs in a communication display 93 which may turn on/off, flash and/or change color to indicate an instruction, a state, or a change to a user. Inside each manifold is at least one temperature sensor 95 and 97 respectively each of which is in signal communication with the control board. An airflow sensor 98 may be provided to provide data on rate of airflow it too is in signal communications with the control board.

Inside the chamber 60 material 500 (which may be plant material, extract or both) is placed. An optional partition 105 may be provided to bifurcate the chamber. The partition may be a partial divider that need not bifurcate the entire height of the chamber.

The junction of the chamber bottom and the top of the manifolds may be referred to as the first interface 125 and the junction of the cover bottom to the top of the chamber may be referred to as a second interface 150.

During inhalation/use airflows into the manifold and through the device exiting at the fluid exit 79.

The first airflow pathway is called out by arrow 1000 and it shows airflow through the first manifold through the chamber and out the inhalation pathway 79. The second airflow pathway is called out by arrow 1002 and it shows airflow through the second manifold through the chamber and out the inhalation pathway 79.

Figure 3:
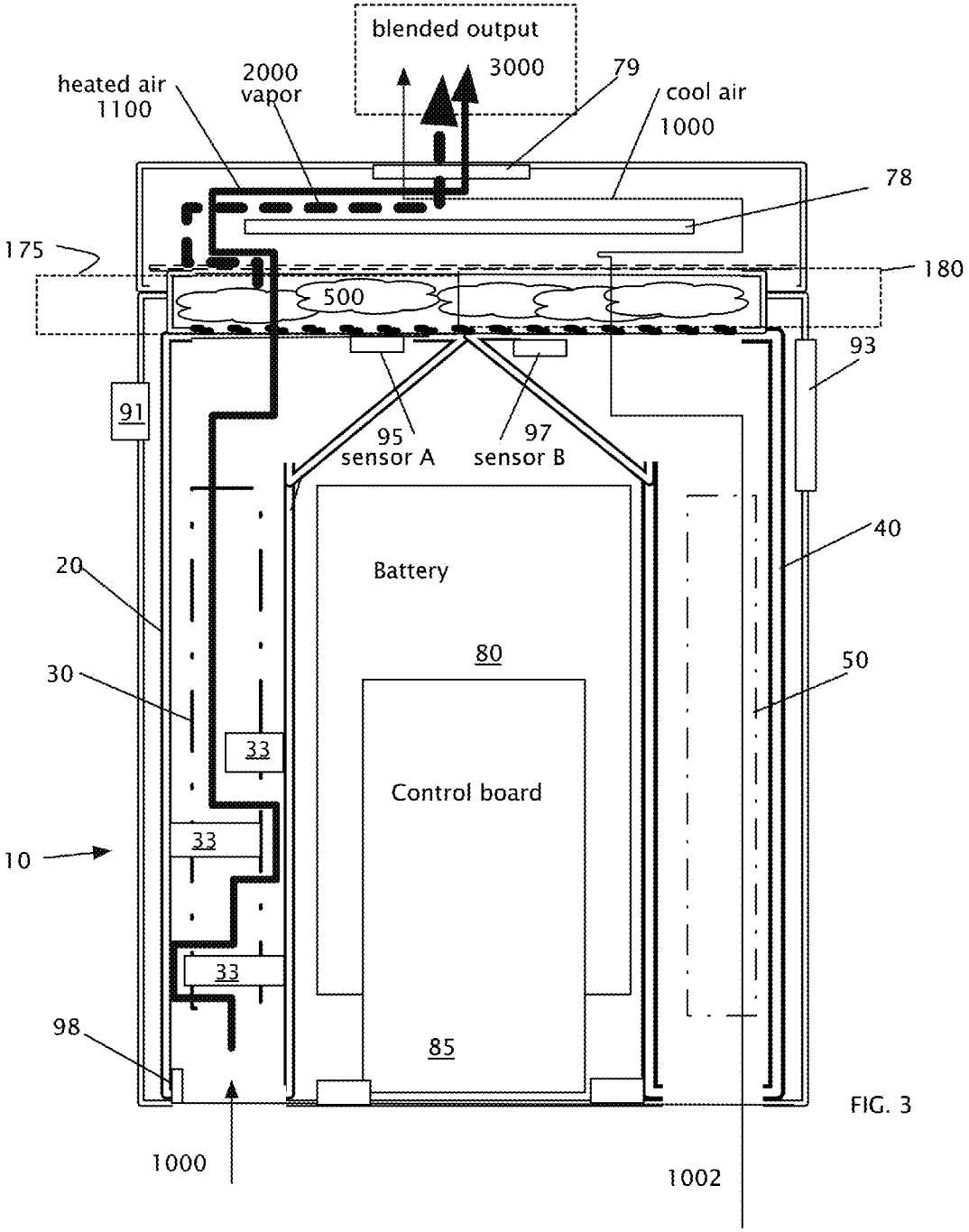

FIG. 3 illustrates a first part of the zoned heating sequence. A user (not shown) turns on the on/off switch 91 and inhales at the inhalation fluid exit 79 of the device 10. In this example the first manifold 20 is the one that is heating up to deliver heated air at a preselected temperature to the material 500 in a first portion 175 of the chamber. Preselected temperatures may include an initial low temperature of about 180 F to 220 F to vaporize terpenes, higher temperatures up to about 405 F are typically used to vaporize THC and other cannabinoids. Those of ordinary skill in the art will recognize that there will be heat losses in the system and that it may be preferable to heat the manifold fluid cavity above 405 F to deliver about 400 F heated air to the material 500. The measurement of temperature via the thermistors or other temperature sensors 85 and 97 is used to tune the temperature the heaters provide. The sensors are in thermal contact with their respective manifolds and in signal communications with the control board. The heaters maybe a coil wire, kapton or silicone tape with metalized flat elements, Balco, iron-chromium-aluminum (FeCrAl) alloys, nichrome (nickel chrome alloy) wires, filaments or any material which does not outgas at the desired temperatures. Although heaters are shown inside the manifold body, they may be positioned in thermal contact to the manifold's exterior and heat a portion of that wall to transfer heat to the fluid within the manifold. The control board 85 also communicates to the user via the LEDs 93. A particular color such as red or orange may be the "wait" color. A "go" color may be green or blue. Upon seeing the go color the user inhales. If during inhalation the LED turns back to a wait color, or otherwise indicates to wait, the user slows down or stops inhalation until the system determines the manifold has reached the proper temperature.

The air that enters the first manifold 20 is heated by the heater 30 and becomes the heated air 1100, which moves through the manifold, around optional baffling walls 33, and when said air is at the predetermined temperature the heated air will vaporize volatile oils, essential oils and other organic compounds from the material. The released vapor 2000 can be drawn out of the device. from the material. The heated air, 1100, and vapor 2000 pass into the cover. At the same time, in this device, cool air 1002 is illustrated as being drawn into the non-activated second manifold 40 wherein the heater is not being actively heated. The optional baffles 33 can be used to direct the airflow to provide a pathway through the manifold allowing more contact time between the fluid (air) and the heat source. The cool air 1002 passes through the device, through a second portion 180 of the chamber and blends with the vapor 2000 and heated air 1100 in the cover thereby forming the blended output 3000 at the inhalation fluid exit 79. This methodology cools the heated vapor and reduces the need for large cooling paths, it also may reduce t vapor condensing and sticking on parts inside the internal cavity 72. To further control the blended output 3000 a user may restrict, limit or close off a portion of the second fluid intake pathway 46 during inhalation to limit or otherwise restrict cool air intake.

When the controller determines that the first portion 175 of the chamber has been provided heated air for a determined amount of time is complete the controller turns off the heater in the first manifold 20. A completed timed heating may be referred to as "timed out". If after a portion of a chamber is timed out and the device remains "on" the controller will initiate heating of the second manifold via the second heater 50 and the process of inhalation, temperature monitoring and heating continues.

When the control board determines that the second portion 180 of the chamber has timed out the controller turns off the system and communicates to the user of a state change. Communications may be via the LEDs 93 whereby the user may chose to reload the chamber with fresh material. When all sections of the chamber have timed out a heating cycle has been completed.

Figure 4:
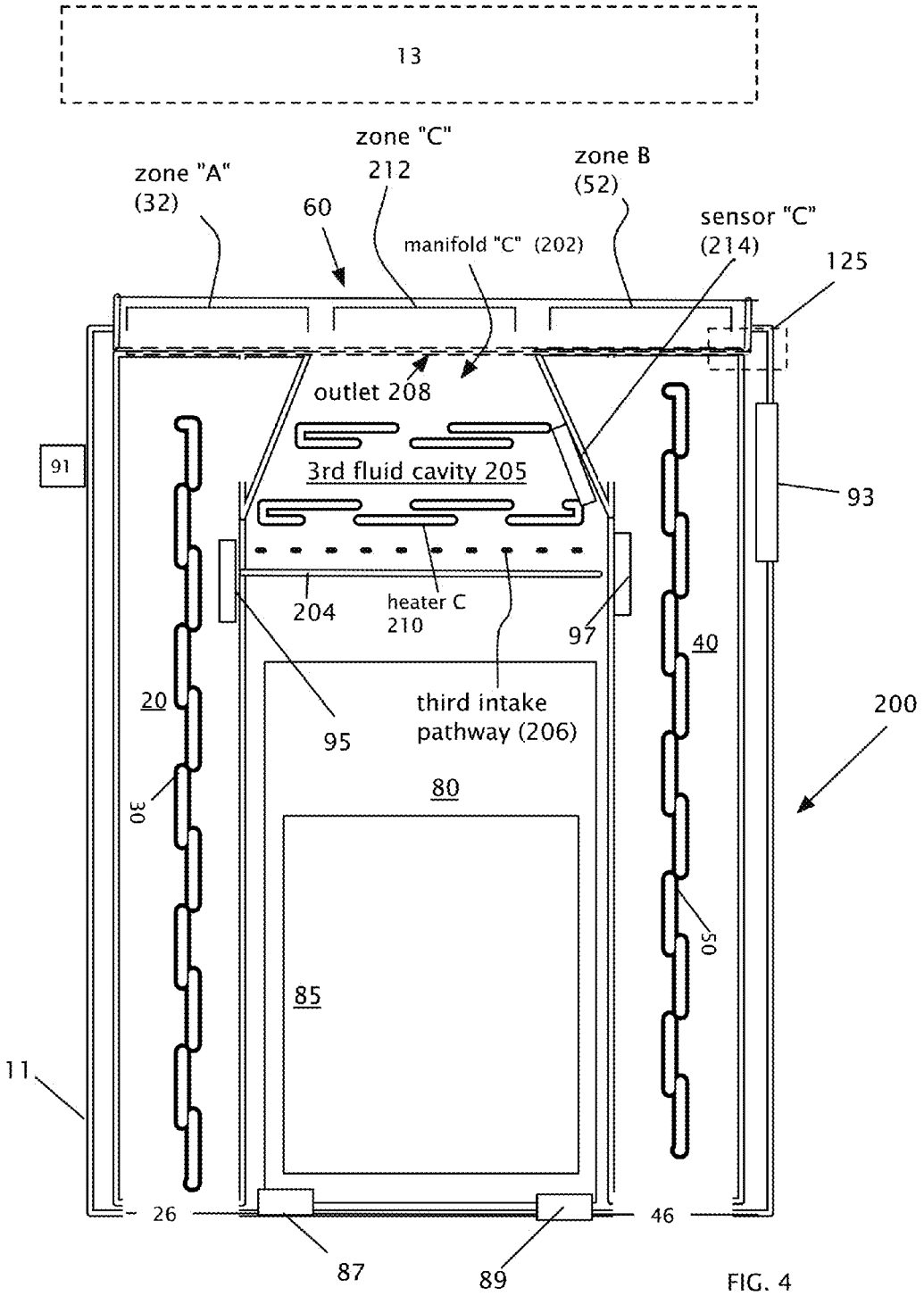
FIG. 4 illustrates aspects of manifold vaporizer with triple zone heating.

FIG. 4 shows a triple manifold vaporizer 200. A third manifold (Manifold "C") 202 is placed in the body 11 between the first and second manifolds (20 & 40). The third manifold 202 comprises a wall 204 a fluid cavity 205, an intake pathway 206, an outlet pathway from manifold "C" 208 to the chamber, and a heater. The third intake pathway 206 through the body 11 is formed whereby air can be drawn into the third manifold 202. The third heater 210 is controlled by the control board 85. The manifold wall 204 may be insulated. The third manifold can deliver one of unheated and heated air (to a portion of the chamber) air via the outlet pathway 208 which opens to a third zone (zone "C") 212. A third sensor 214 is in thermal contact with a portion of manifold "C" 202 and is in signal communication with the control board 85. The measurement of temperature via the thermistors or other temperature sensors 214, 95 and 97 is used to tune the temperature each heater provides. One advantage of a three zone convection device is that the controller (or user) may be allowed to select which zones to engage. It is within the scope of this disclosure that combinations of two zones may be heated at the same time. In some implementations, there may be instances when a user or control board requires all zones and all manifolds may be selected to be heated at the same time.

FIGS. 5A-7F illustrate aspects of a manifold vaporizer with one or more valve controlled zones. Valve controlled zones add complexity to the device but make it possible to reduce redundant manifolds by selectively directing heat from a single manifold to a selected zone or portion of the chamber containing material to be vaporized.

Figure 5A:
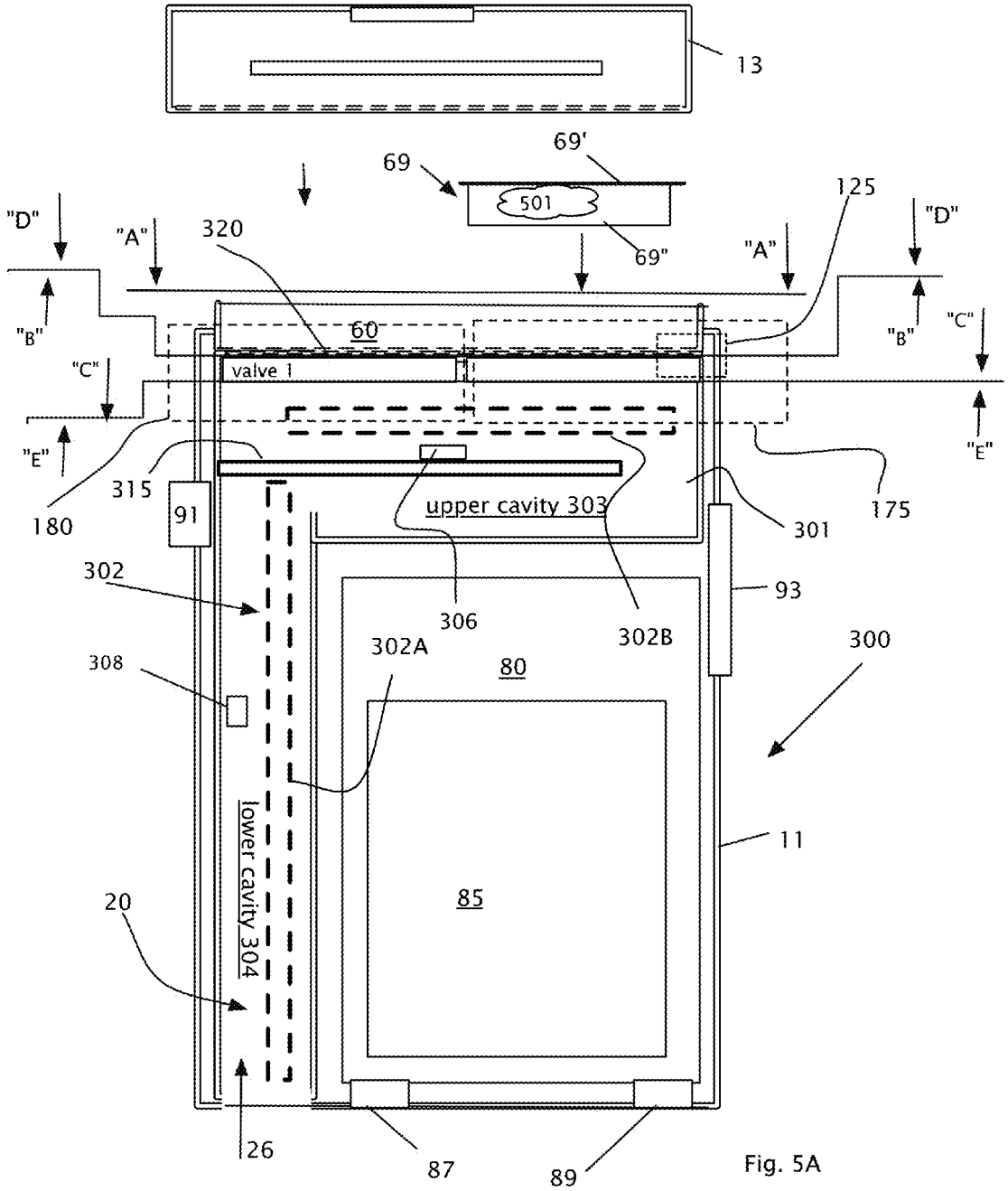
FIGS. 5A-7F illustrate aspects of a manifold vaporizer with a valve controlled zones.
Figure 5B:
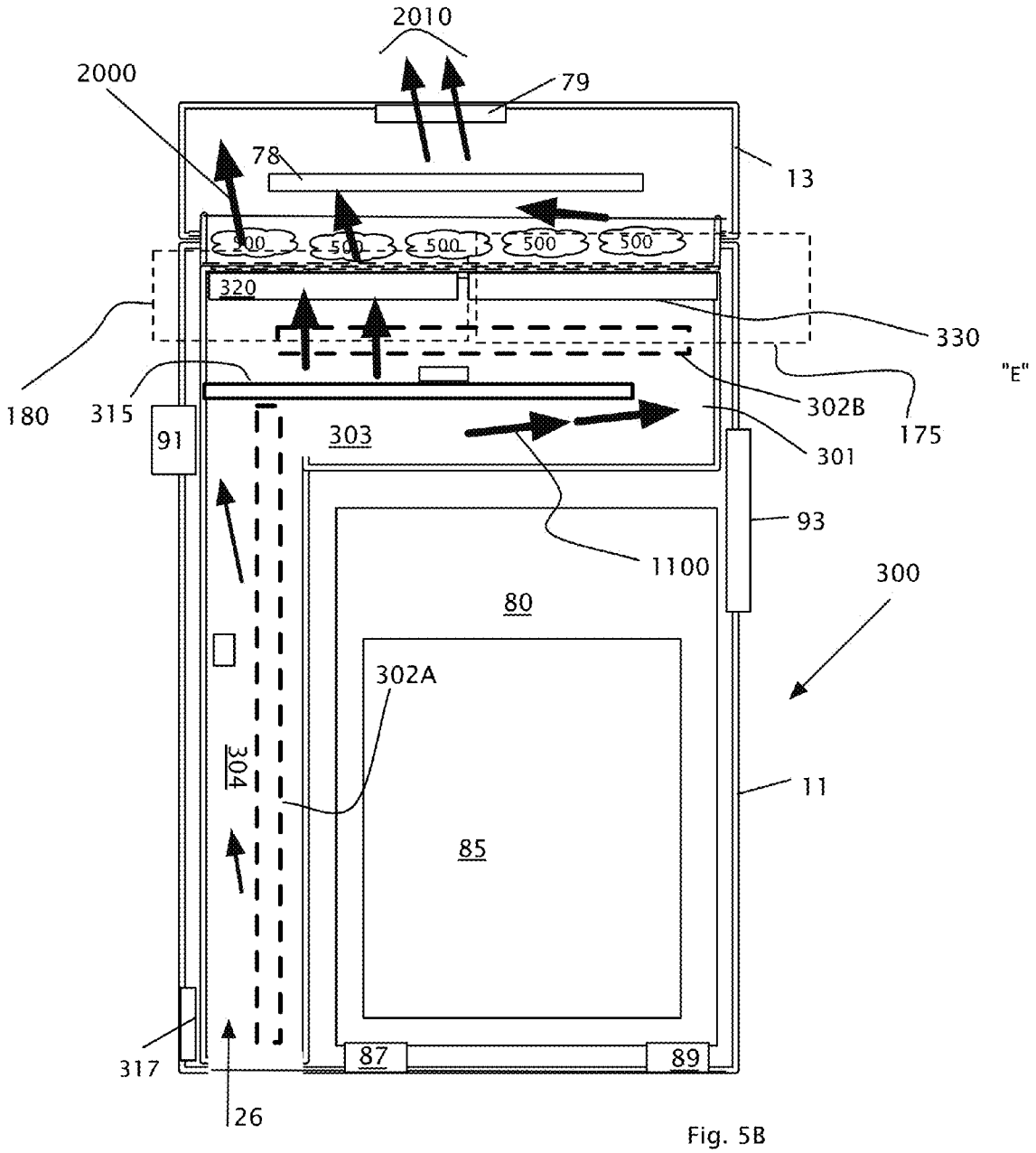

The device 300 has a single manifold 301 with a heater 302. This heater may have two separately controllable sections which may be driven by the controller independently, or be split into two heaters, each heater controlled by the controller. A two heater configuration is shown in FIGS. 5A and 5B, heater one 302A is in the lower portion of the manifold and heater two 302B is in the upper portion of the manifold whereby the upper cavity 303 within the manifold and the lower cavity 304 within the manifold may be heated to different temperatures or turned on and off at different frequencies. Multiple heater zones in a single manifold provide additional opportunity to condition the air and/or fine tune the heat in the manifold to achieve a predetermined temperature at or near the first interface 125. At least one temperature sensor is placed in the manifold and is in signal communication with the control board 85. Shown in FIG. 5A are two temperature sensors. The first temperature sensor 306 is in the upper cavity and the second temperature sensor 308 is in the lower cavity. Part of the method of heating and vaporizing may include adjusting the first heater 302A and the second heater 302B to tune the temperature inside the manifold. Airflow through the manifold may be directed via a serpentine pathway caused by placing a flow directing wall 315 in the flow path. Preheating the incoming air by separately adjusting the heater 302A in the lower cavity and/or heater in the upper cavity 302B is used to finely tune the temperature, it may also be used to compensate for humidity or temperature. Optionally, a humidity sensor such as a capacitive-type humidity and temperature module/sensor 317 may be added, these sensors use a capacitive humidity sensor and a thermistor. The humidity sensor is connected to the board and provides information on the relative humidity. Moister air may be heated more efficiently and the controller may adjust the temperature cycle for start-up based on such information.

At the first interface 125 are placed one or more valves. In some instance one area of the manifold may be unvalved and a pass through fluidly connected with a portion of the chamber 175. In that case a single valve 320 will be open to the second portion of the chamber 180. The valve 320 will open or close at preselected times to open the second portion of the chamber 180 up to heated air for vaporization. Optionally, both the first and second portions (175 and 180) of the chamber are valved. In such instances a first 320 and second valve 330 are utilized to control heated airflow into portions of the chamber.

Optionally an extract carrier 69 with an open top 69', and a bottom 69" may also be permeable to vapor. The carrier may be added to the chamber. The extract carrier sits in at least a portion of the chamber, allows some heated airflow around it (and optionally through it) and uses the heat to heat up the body of the carrier to vaporize extract.

FIG. 5B shows usage wherein the on/off switch 91 is engaged and the first valve open. The optional second valve 330 is added in this illustration and it is shown in the closed state. The heated air 1100 is drawn up into the manifold, around the wall 315 and through the first valve 320 which is actuated to open and released into the second portion 180 of the chamber 60 through the material 500 to release vapor 2000 into the cavity 72. The first portion of the chamber 175 and the material therein are not exposed to the direct flow of the heated air because the second valve 330 is closed. The vapor 2000 and heated air 1100 pass through the baffle 78 which also may function as a heat sink and will cool some of the vapor and air forming the cooled inhalant of vapor and air 2010 which during inhalation passes through the inhalation fluid exit 79. The control board 85 signals the user via the communications lights 93 when it is time to close the first valve 320 and to actuate (see FIGS. 6A to 7F) the optional second valve 330.

When the user actuates the second valve the inhalation process can continue as described above but through the first portion 175 of the chamber and through the spared material 500 which was not previously subjected to the heated airflow from the manifold.

For valved devices or multiple manifold devices one aspect that is within this disclosure is the user may select material, extract (which may also be a concentrate) type and properties for each section of the chamber. A user may place 8% THC and 2% CBD material in the first portion 175 and place 20% THC and 0.3% CBD material in the second portion 180 thereby sequencing which material and THC/

CBD content to vaporize. The disclosure is not limited to CBD and THC and includes all cannabinoids and vaporizable material.

Valves and Vave Actuation

Valves are know in the art as are manually operated valves, the few specific examples illustrated herein are not meant to be a limitation and those of ordinary skill in the art will recognize that other suitable valves, manual, pneumatic, and electrical may be substituted for the valves shown without departing from the scope of the disclosure.

Figure 6A:
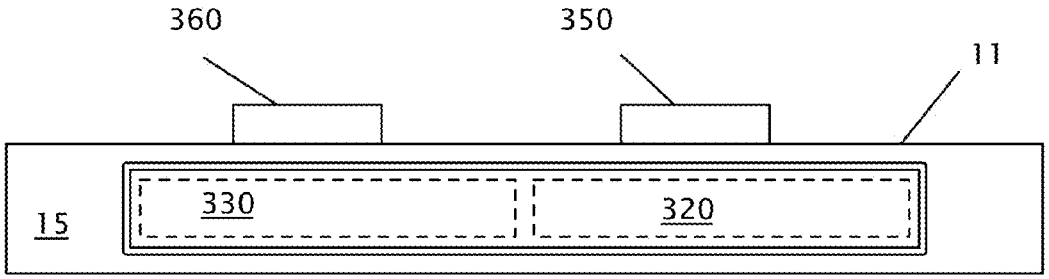
Figure 6B:
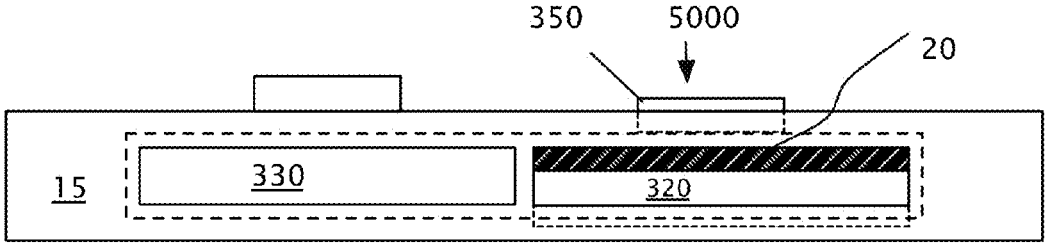

FIGS. 6A and 6B show a view along the line of "D"-"D" in FIG. 5A. This view is from below the chamber to the manifold through the first interface 125. Through the top surface 15 of the body 11 has an open top 14 beneath which are the first valve 320 and the second valve 330. FIG. 6B shows the actuation (and opening) of the first valve 320 via pressing in the first button actuator 350 along the line of arrow 5000. The second button actuator 360 is not engaged and the valve remains closed. The opening of the first valve 320 opens up a view into the manifold 20. Heated air flows through the open valve during inhalation to vaporize the material in one of the first and second portions (175 and 180) of the chamber adjacent to the open valve. Which flows out the cover and inhalation exit.

Figure 7B:
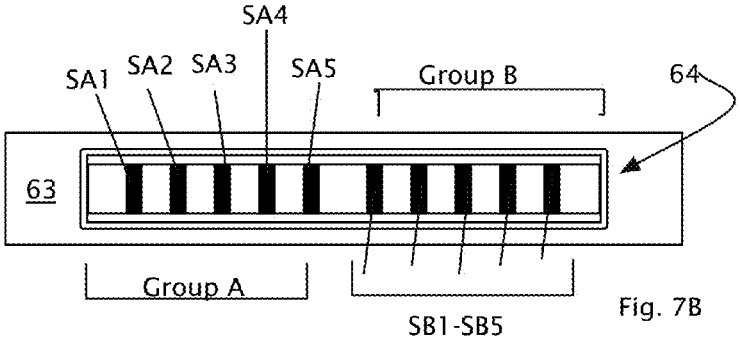
Figure 7C:
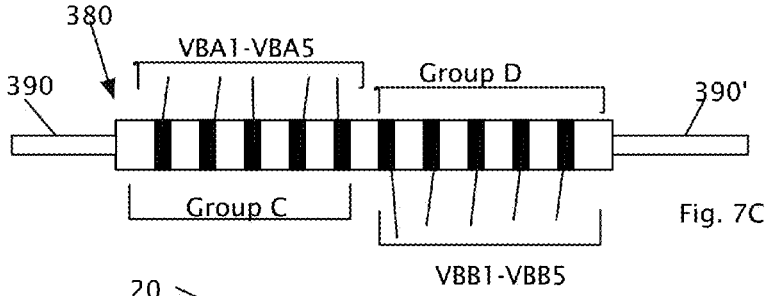
Figure 7D:
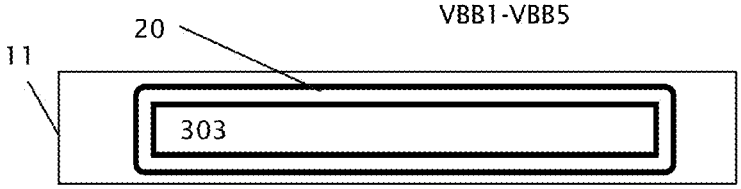
Figure 7A:
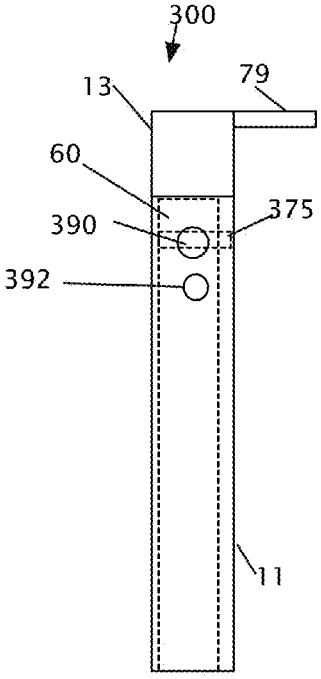

FIG. 7A shows a side view of an exemplary implementation of a thin vaporizer 300 with valve structures 375, valve body 380 and actuators 390. FIGS. 7B-7F show the details of the slotted valve arrangement and structures 375.

FIG. 7B is a view along the line of "B"-"B" of FIG. 5A looking upward at the bottom or floor 64 of the chamber 60. Formed as part of, or affixed into the floor 64 are offset grouping of slits. Group "A" locations roughly correspond to the first portion 175 of the chamber. The slits of group "A", SA1-SA5 are spaced openings through which heated air 1100 may flow when the are aligned with the valve slits to first portion 175. Group "B" locations roughly correspond to the second portion 180 of the chamber. The slits of group "B", SB1-SB5 are openings through which heated air 1100 may flow when they are aligned with the valve slits to second portion 180.

FIG. 7C shows the valve body 380. The valve body has actuator legs 390 and 390'. In the valve body are two groups of slits. The slits of group "C", (VBA1-VBA5) and the slits of group "D", (VBB1-VBB5). The slits are arrange such that only one of group "C" and group "D" slits align with the slits SA1-SA5 (group "A") or slits SB1-SB5. The actuators 390 & 309' are utilized to slide the valve body across the floor of the chamber 64 and align one of group "C" or group "D" slits with the group "A" or group "B" slits.

FIG. 7D shows a view from line "C"-"C" of FIG. 5A showing the body 11 and its open top and the upper cavity 303 of the manifold 20.

Figure 7E:
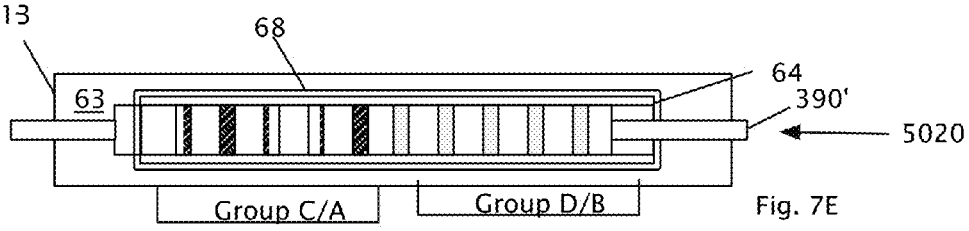
Figure 7F:
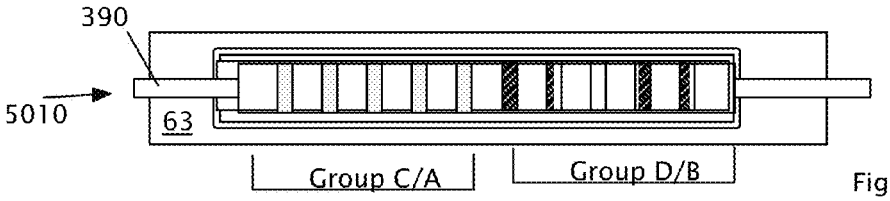

FIGS. 7E and 7F show a partial view from the line "E"-"E", the actuation of valve one 320 and the actuation of valve two 330 via the alignment of Group "D" slits with Group "B" slits or the alignment of Group "A" slits with Group "C" slits. Actuation legs 390 or 390' are pressed in towards the body along the line of arrow 5010 or 5020 depending on which of the valves (320/330) are desired to be opened. Heated air 1100 flows through the manifold and the open valve during inhalation to vaporize the material in one of the first and second portions (175 and 180) of the chamber adjacent to the open valve. Which flows out the cover and inhalation exit. In some instance only a single valve may be provided wherein one portion of the chamber is vaporized initially and continues to be open (to allow flow of additional air) during vaporization of the valved section.

The communication indicator LED 93 communicates with the user when the vaporizing in one of the first or second portion is completed. The determination is based on at least one of time, heat, airflow and material type. LUTs may be used by the controller to make the determination. The user is informed, cued or shown (via illumination) that the next actuator leg needs to be depressed to open the next valve. When all portions of the chamber have timed out a heating cycle has been completed and the controller will then shift of power to heaters until such time as a condition is met. conditions include removal of the cover and an override by the user. In the case of the heating cycle being completed the communications display 93 illumination instructs the user that the cycle has been completed. Although not shown communication may also be via vibration of the case or via an audible signal—both communication means controlled by the controller.

The indicator lights may use different colors in a predefined communication sequence of color, flashes or both. The device may place LEDs 392 at or near the actuator legs 390/390' to cue the user on which one to depress such as "on" for press and or green for "press".

Figure 8A:
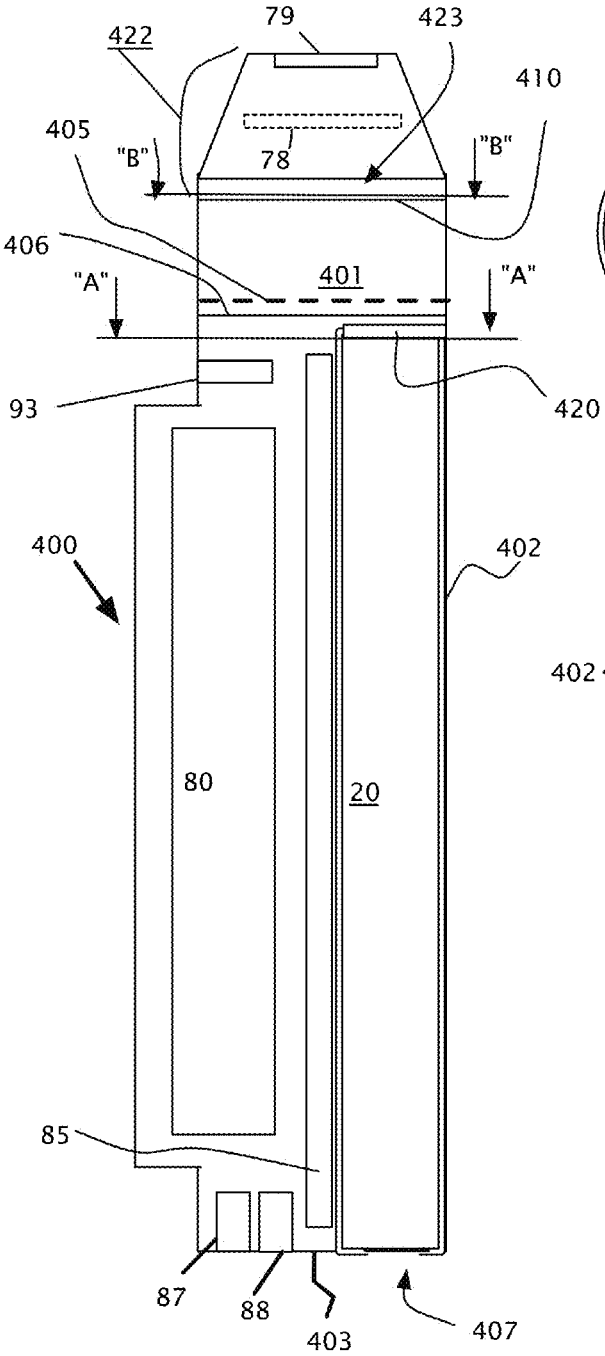
FIGS. 8A-8C illustrate aspects of a rotating multi-zone vaporizer.
Figure 8B:
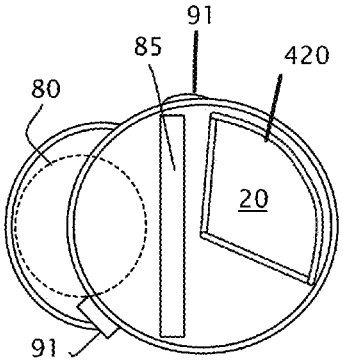
Figure 8C:
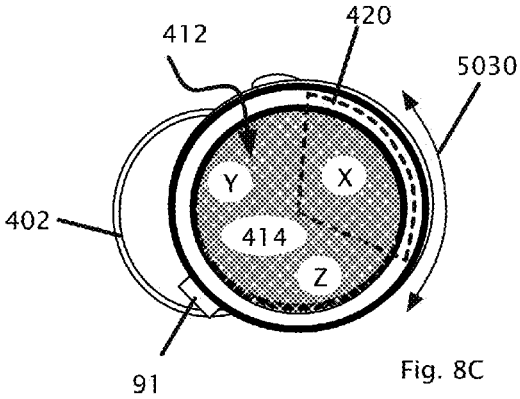

FIGS. 8A-8C illustrates a vaporizer 400 with a rotating multi-zone chamber 401. The body 402 is generally hollow with a closed bottom 403 and an open top 404 with a first rotating interface 405 which mates with the bottom 406 of the chamber. The intake 407 is at the bottom of the manifold. The open top of the chamber 410 opens to the chamber cavity 412 which has an open bottom having a floor 414 which is permeable to vapor and heated air. The manifold 20 has an open top 420 which is shaped to less than the chamber size, shown in FIG. 8B is a ⅓ the size of a chamber floor sized manifold open top 420. An inhalation top 422 fits over the chamber at its open bottom 423 and inhalation is via the inhalation exit 79. FIG. 8B a view along the line of "A"-"A" of FIG. 8A. FIG. 8C is a view along the line of FIG. 8A.

During use the manifold top 442 provides heat to the chamber via the chamber floor. The shaped manifold top provides heat to a section "X" (and any associated material) of the chamber. FIG. 8C shows section "X" aligned with top of manifold 420. During inhalation the heated air 1100 travels in the intake 407 then through the manifold 20 and out the shaped top of the manifold 420 through the floor of the chamber 414 and through section "X" and any material therein, thereby releasing the vapor 2000 which travels through the inhalation top 422 and baffle 78 cooling the vapor to form cooler vapor 2010 and exiting through the inhalation fluid exit 79. Upon rotation along the line of arrow 5030 a user can turn the rotating chamber and attached top 422 to move to the next section ("Y" or "Z").

Figure 9A:
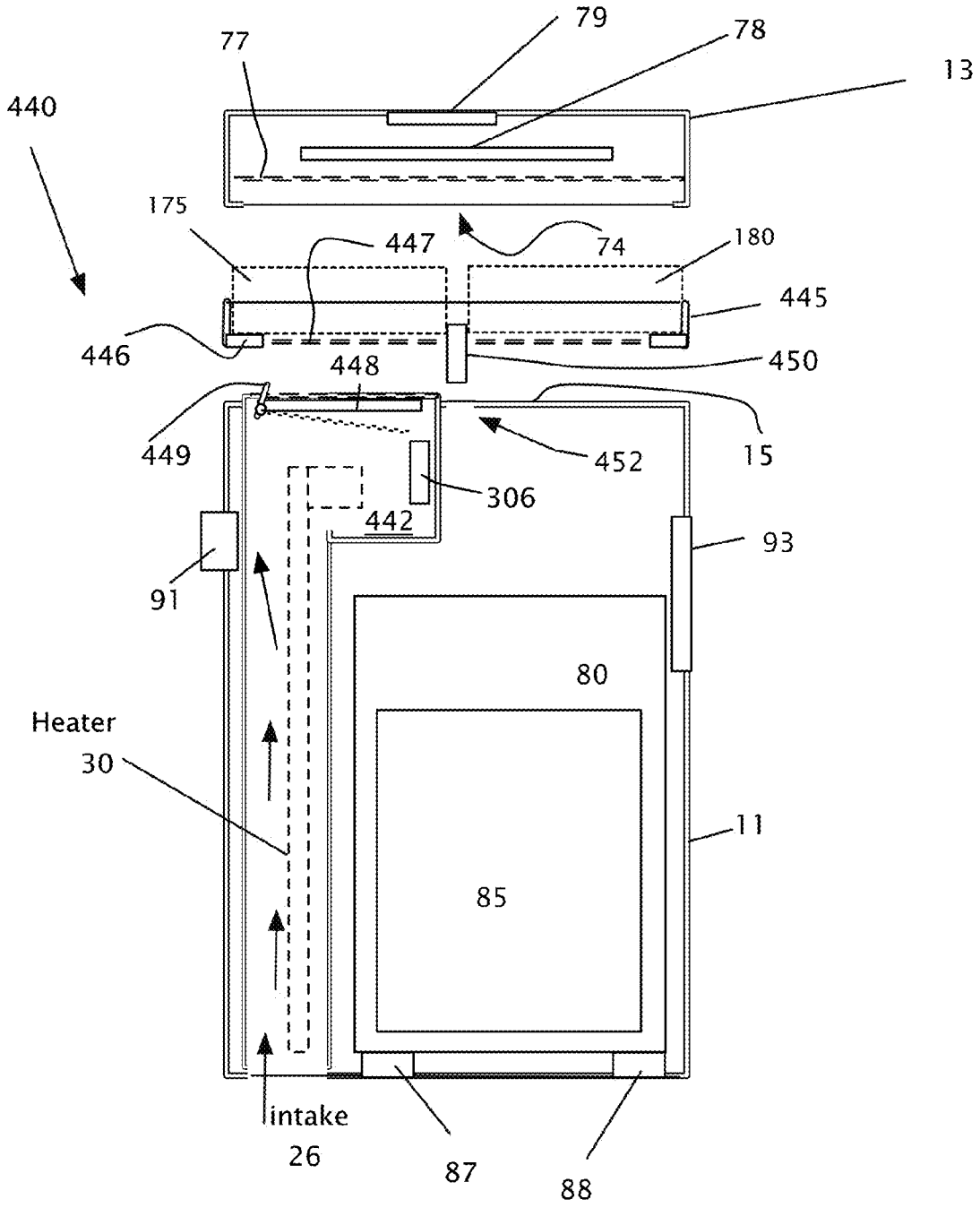
FIGS. 9A-9D illustrate aspects of a multi-positional vaporizer.
Figure 9B:
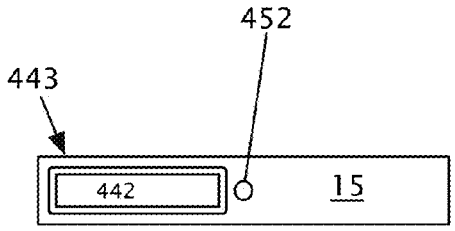
Figure 9C:
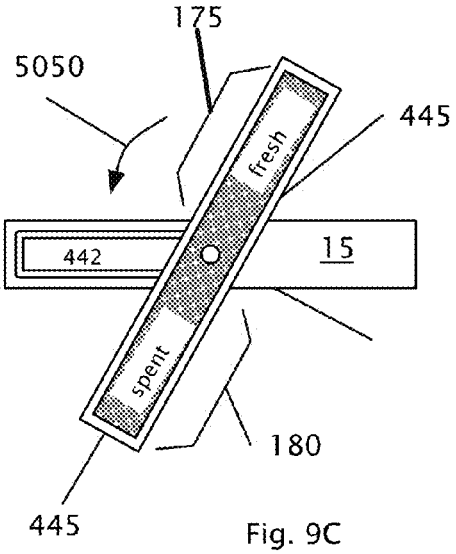
Figure 9D:
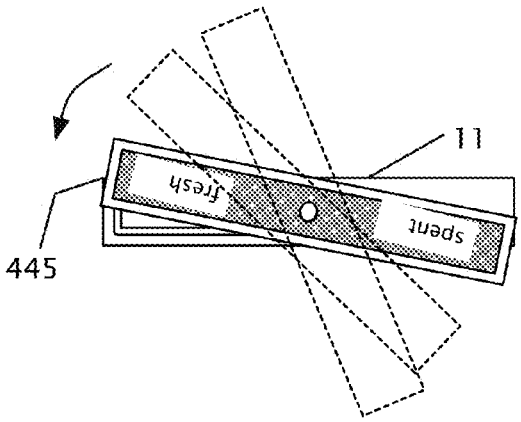

FIGS. 9A-9D show an exemplary implementation of a thin vaporizer with a rotating chamber 440. FIG. 9A is a cutaway view. The manifold 442 with a manifold open top 443 is inside the body 11. Above the manifold is a chamber 445 with a bottom 446 supporting a permeable screen 447 and with a pivot 450 attached thereto through a pivot hole 452 in the top of the body 15. A cover 13 with an open bottom 74 and a screen 77 affixed therein between the open bottom and the inhalation exit 79 fits onto the chamber.

To alternate between the first portion and second portion of the chamber 175 and 180 a user rotates the chamber along the line of arrow 5050 to align the first or second portion (175 and 180) over the manifold's open top 443 whereby heated air from the manifold may be drawn into the portion of the chamber above the manifold's open top, Vapor can pass through the open top into a first of second portion of the chamber and through any material therein. This material in the portion of the chamber remote from the manifold's open top is spared from the direct heat of the heated air flowing through the manifold, until such time as the user rotates the chamber an aligns the other portion with the manifold's open top. A pressure actuate flap valve 448 closes off the top of the manifold 443 when the chamber is displaced for rotation, when the chamber is realigned with the body an actuator 449 is activated and the flap valve is opened.

Figure 10A:
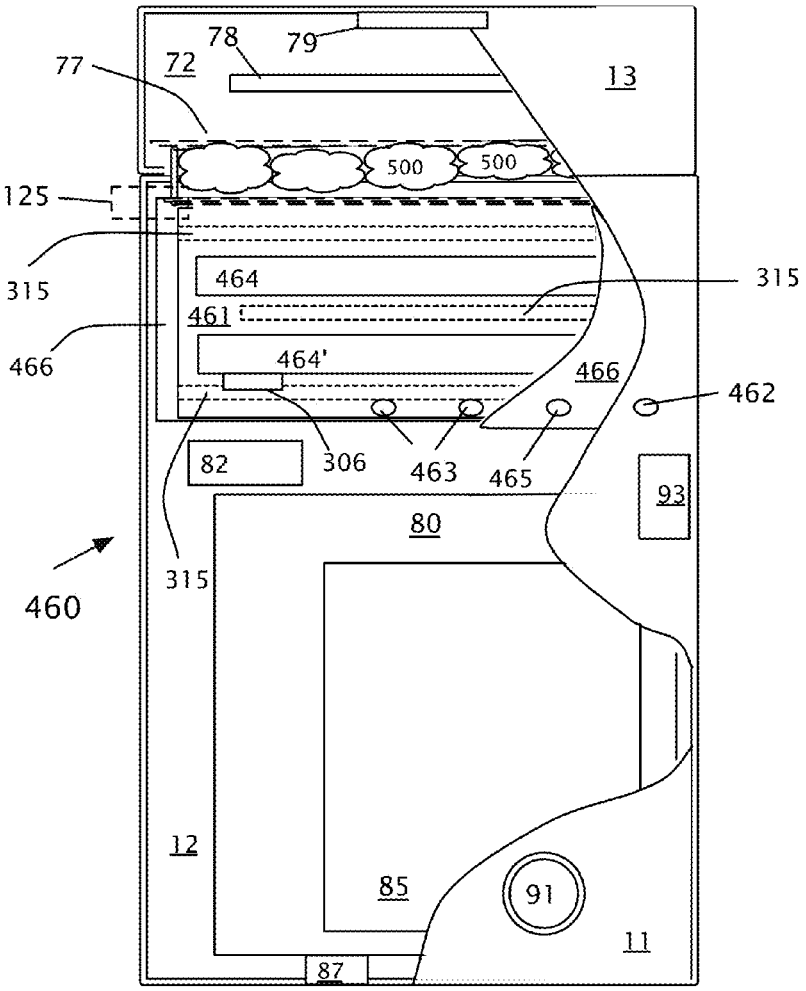
FIGS. 10A-10C illustrates aspects of a single thin convection vaporizer.
Figure 10B:
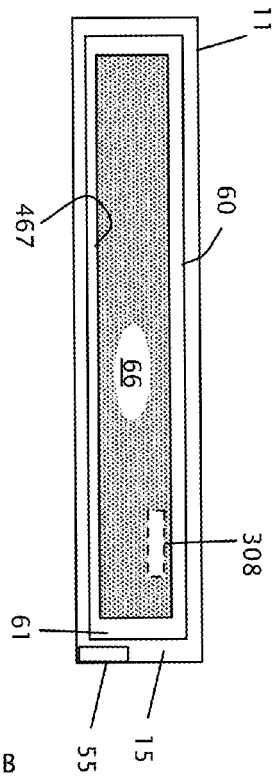
Figure 10C:
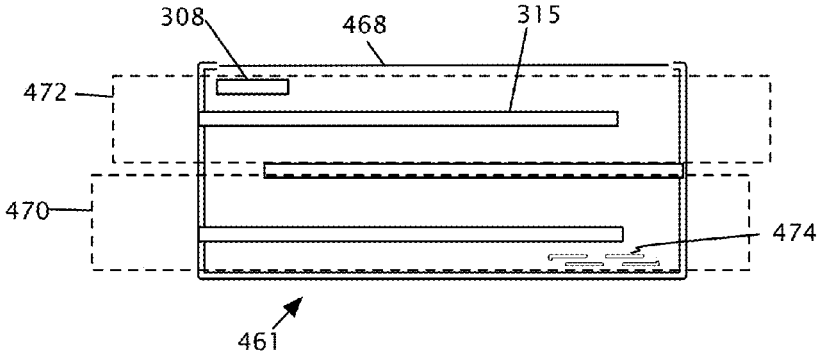

FIGS. 10A-10C show aspects of a single manifold vaporizer with multiple heating zones within the manifold. FIGS. 10A and 10B shows a partial cut-away view of a convection vaporizer 460 and a top view of the device with the cover removed. Inside the body 11 is a battery 80, a back-up battery 82, and a control board 85.

The manifold 461 is generally hollow with intakes and an open top. The manifold is flat and has a thin height. The manifold may have baffles or walls 315 inside the interior to direct airflow. The manifold is fluidly connected to the exterior of the body via vents 462 which fluidly communicate with manifold intakes 463. Any areas of insulation covering the manifold in proximity to the vents have openings 465 to allow air flow. Heating elements 464 and 464' is shown on one exterior wall of the manifold, the heating element is in thermal contact with the manifold and the material the manifold is constructed of provides thermal transfer through the exterior wall into the airspace within the manifold. The manifold and heating element is at least partially enclosed with thermal insulation 465. Optionally one or more additional heating elements are placed on other walls of the manifold. The chamber 60 is generally hollow, it has a top wall 61 which has an opening 62 top surrounding the inner annular wall of the chamber 467. The chamber has a bottom wall and a floor 66 which is a screen, slits or other air and vapor permeable region.

The heating elements are controlled by the controller 85. Also within the case and/or manifold is at least one temperature sensor. Shown are a first sensor 306 on the exterior of the manifold and a second sensor 308 inside the manifold. The locations shown are not a limitation. However, it is preferred, when forming a heat zoned manifold, to use one or more temperature sensors to adjust the first and second heating of regions via adjustment of the heating elements 464 and 464'. Optionally a cover removal sensor is included. Optionally a humidity sensor is included. Optionally an airflow sensor is included. All sensors are in signal communication with the controller. Airflow sensors provide information to the controller which represents the volume of air taken into the manifold. Rate of airflow can be derived from airflow measurements. A faster rate of airflow may require more heating of the manifold then a slower rate of airflow. The controller controls these variables to provide heated air to the chamber within a predetermined temperature range, or the controller uses the communication display to communicate to the user that the user needs to inhale more slowly or wait until the manifold reaches a temperature.

An on/off switch 91 is on the body/case and a communications display 93 can be seen on the outside of the body. Multiple heating elements positioned in specific locations on the manifold are used to tune the heating of the air. The positioning may also correspond to the placement of the optional internal baffles or walls 315 and/or temperature sensors. A cover 13 is placed over the body and chamber. FIG. 10C shows zoned regions within a manifold with multiple heating elements. The zoned regions represent local areas of heated air and heated manifold each being monitored by the controller via at least one temperature sensor in that zone. A first zone 470 and a second zone 472 are formed. Each zone is associated with at least one heating element. Optionally a third heating element 474 may be placed in thermal contact with the manifold. In FIG. 10C that placement is within the manifold. The location of heating elements inside, outside or both inside and outside the manifold are aspects of various heating processes and methods.

Figure 11:
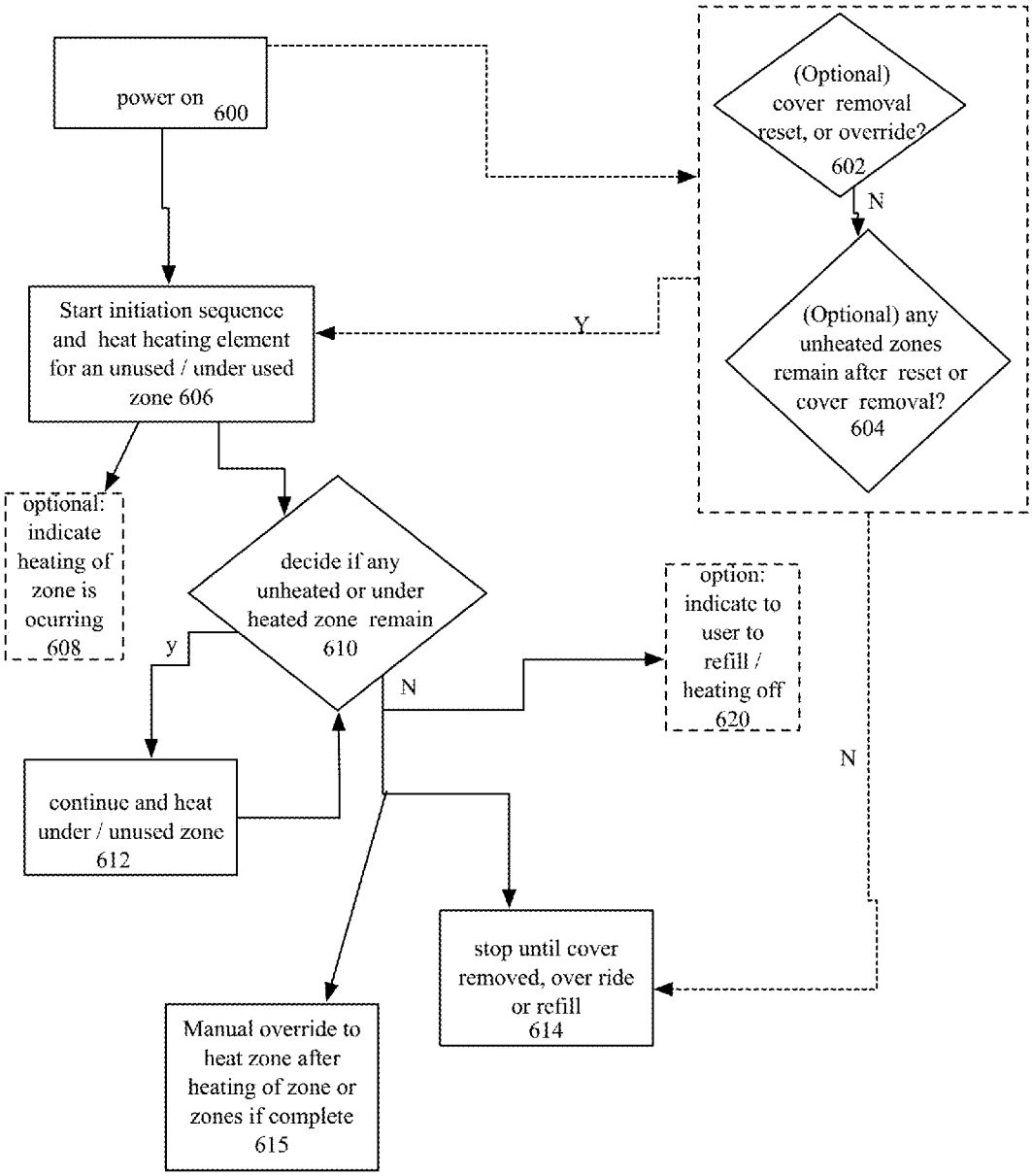
FIG. 11 illustrates aspects of control logic for a convection vaporizer controller.

FIG. 11 is a process diagram of aspects of controller logic for a vaporizer. Power is turned on 600 for the device. Optional determine if heating chamber has gone through a full cycle of heating all portions of the chamber/zones without lid/cover removal or user selects override 602 to reheat chamber after heating cycle is completed. If no reset of override then optionally decide if any unheated portions of the chamber/zones remain 604. Next, start an initiation sequence to heat a heating element for an unused zone 606. Optionally, indicate via indicator (communication display) that heating is occurring 608. Determine if any unheated heat zones remain 610. If unheated or not fully heated zone remains heat 612. Not fully heated refers to a heated zone which did not heat for a completed amount of time. If all heating zones have been fully heated stop 614. Turn heating elements off and do not heat until confirmation of refill, such as a cover removal, or a user override to have one last attempt to extract additional vapor by reheating used zones either individually or as a group 615. After heating a heating zone via providing power to a heating element then determine if the heating sequence has heated all heating zones and is complete 610. If completed cycle/sequence then turn off heating until cover is removed. If sequence is complete and heating of zones is stopped indicate to user via communication display such as LED indicator lights 620.

Figure 12:
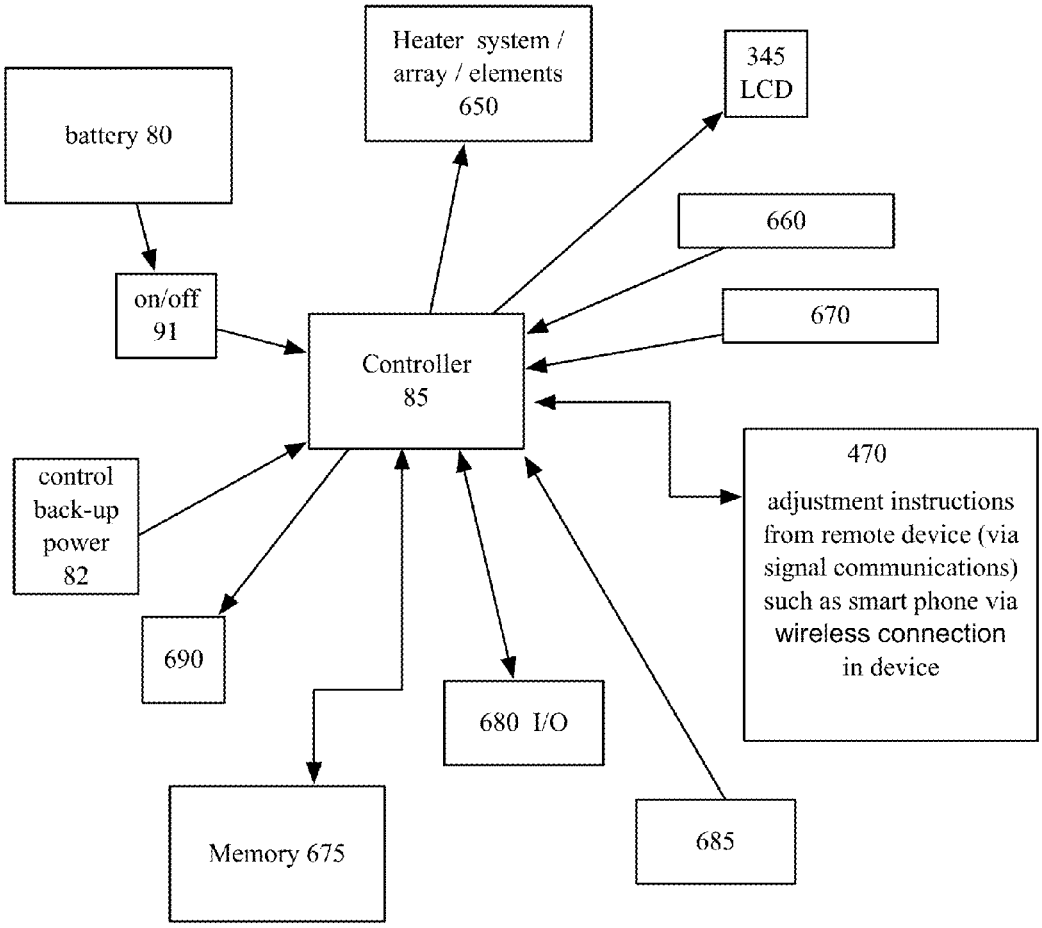
FIG. 12 illustrates connections between the controller and some other components in the system.

FIG. 12 shows a aspects of a controller 85 in electrical and/or signal communication with other system sensors and components. The battery 80 to power the controller and the device is connected to an on/off switch 91 wherein power is supplied to the controller. Optionally the system may have a back-up battery power supply 82 which supplies power to the controller or other components when the main battery 80 is disconnected. Alternatively memory either volatile or non-volatile will store data on system parameters when the controller is not powered. The controller instructs the on/off of heating elements within the heating system 650. One or more temperature sensors 660 provide temperature measurements to the controller. A open/close sensor 670 is used to determine if the lid of the device has been removed and may be used to reset the initiation sequence based on assumptions such as an opened lid equates to a refilled heating chamber. The controller can be in signal communications with memory 675. Communication between a computer or smart phone with the controller may be via an input/output 680. Input to the controller may also be via the user input 685 and a status indicator such as a colored LED communication illumination 690 and/or an LCD 695 type display can show a setting such as the heat setting for the heating chamber or the length of time of each heating cycle. The LCD and the status indicator are controlled by the controller whereby a status such as heating a heating element is indicated or system has determined the zones have all been heated and heating has been stopped, or the device needs to be recharged. In some instances the controller may receive adjustment instructions via a computing device of smart phone in wireless signal communication with the controller.

It will be understood that various aspects or details of the disclosures may be changed combined, or removed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

What is claimed is:

1. A portable vaporizer comprising:

a battery power supply;

a generally hollow body containing a manifold having an open top;

an intake fluidly communicating from the exterior of the body to the manifold;

a convection heating system comprising;

at least two heating elements each in thermal contact with the manifold;

at least one temperature sensor positioned in the manifold;

a controller in signal communication with the temperature sensor;

a chamber having a air permeable floor fluidly connected to the open top of the manifold;

an illumination communication display;

an on/off switch;

a cover that mates with the body above the chamber having a fluid pathway for vapor inhalation; and, wherein the controller controls the power supplied to each heating element in response to information it processes from the temperature sensor.

2. The vaporizer of claim 1 wherein the controller is in signal communication with the communication display.

3. The vaporizer of claim 1 further comprising at least one wall within the manifold to direct airflow.

4. The vaporizer of claim 3 further comprising a second temperature sensor within the manifold.

5. The vaporizer of claim 4 further comprising two zoned regions in the manifold each associated with a temperature sensor.

6. The vaporizer of claim 5 wherein the controller controls each heating element to tune the temperature of the air passing through each zone of the manifold.

7. The vaporizer of claim 1 further comprising:

a cover off sensor in signal communication with the controller; and, wherein the controller interrupts power to heating elements of the cover is off.

8. A vaporizer system comprising:

a controller;

a heating chamber having an open top surrounded by an annular wall and having a air permeable floor;

a manifold in thermal contact with at least two heating elements;

an intake to allow air to pass into the manifold;

an exit to allow heated air to pass out of the manifold;

an on/off switch;

a power supply;

a cover with an interface to close off the open top of the chamber;

an inhalation intake connected to a fluid pathway passing from inside the cover; and, wherein the power supply is electrically connected to the heating elements and the controller via the on/off switch; and, wherein each heating element is separately controlled by the controller.

9. The system of claim 8, further comprising at least one temperature sensor in thermal contact with the manifold connected to the controller and the controller in response to temperature sensor measurements adjusts the amount and/or timing of electricity provided to a turned on heating.

10. The system of claim 8 further comprising an illumination communications controlled by the controller.

11. The system of claim 8 further comprising a body surrounding at least the heating chamber.

12. The system of claim 11 further comprising an illumination communications system controlled by the controller visible from the exterior of the body.

13. The system of claim 8 wherein the controller at least one of monitors the amount of time a heating element is at a predetermined range of temperature and monitors when a predetermined time is met.

14. A vaporizing method, the method comprising: placing organic plant material in a chamber; connecting a manifold having a heater therein controlled by a control board connected to a battery supply to at least one valve whereby a fluid pathway for air is provided to the valve; providing a fluid pathway from the valve to at least a portion of the chamber; partially sealing the chamber with a cover having a fluid exit; heating the air in the manifold to a predetermined temperature; the user actuating the valve to open the fluid pathway; the control board indicating to the user via an illumination communication that the users may inhale; and, during inhalation at the fluid exit heated air from the first manifold passes through a predetermined section of the material in the chamber releasing vapor.

* * * * *